United States Patent [19]

Blümel

[11] Patent Number: 4,896,643

[45] Date of Patent: Jan. 30, 1990

[54] METHOD AND ARRANGEMENT FOR CONTROLLING THE FUEL/AIR RATIO OF AN INTERNAL COMBUSTION ENGINE

[75] Inventor: Thomas Blümel, Schnitten, Fed. Rep. of Germany

[73] Assignee: VDO Adolf Schindling AG, Frankfurt am Main, Fed. Rep. of Germany

[21] Appl. No.: 270,679

[22] Filed: Nov. 14, 1988

[30] Foreign Application Priority Data

Nov. 27, 1987 [DE] Fed. Rep. of Germany ..... 3740268

[51] Int. Cl.[4] ..... F02D 41/14; F02D 41/26

[52] U.S. Cl. ..... 123/489; 123/440

[58] Field of Search ..... 123/440, 489; 364/431.05

[56] References Cited

U.S. PATENT DOCUMENTS

| | | | |
|---|---|---|---|
| 4,459,669 | 7/1984 | Chujo et al. | 123/440 X |
| 4,491,921 | 1/1985 | Sugiyama et al. | 123/489 X |
| 4,505,246 | 3/1985 | Nakajima et al. | 123/489 |
| 4,759,328 | 7/1988 | Blumel et al. | 123/489 X |

*Primary Examiner*—Tony M. Argenbright

*Attorney, Agent, or Firm*—Martin A. Farber

[57] ABSTRACT

In a method and arrangement for controlling the fuel-/air ratio of an internal combustion engine in which the output voltage of an oxygen measurement probe which is arranged in the exhaust pipe of the internal combustion engine is used, after comparison with threshold values, for regulating the fuel/air ratio, the threshold values can be controlled as a function of extreme values of the output voltage.

11 Claims, 4 Drawing Sheets

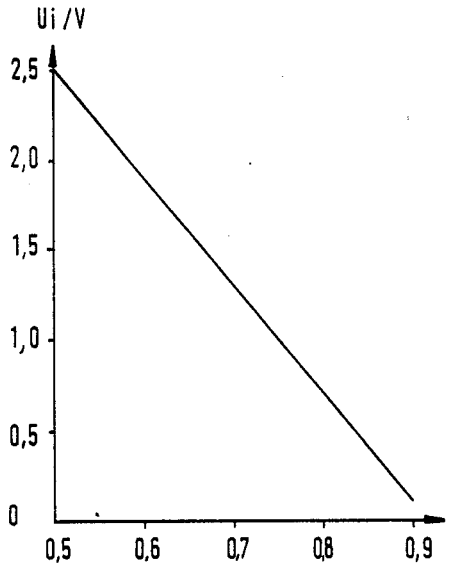
FIG. 4a
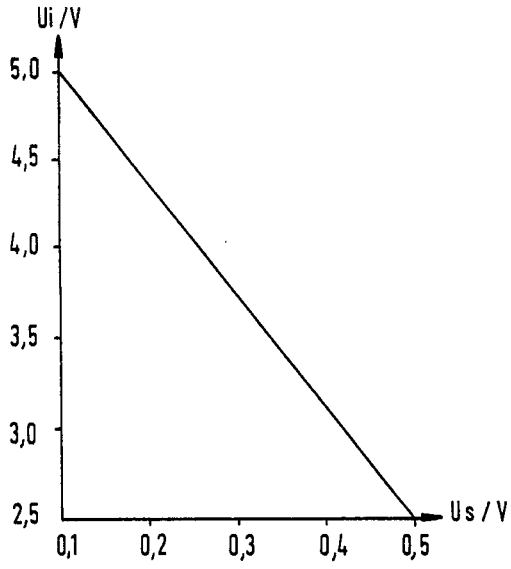
FIG. 4b
| Umin / Umax | 100 | 150 | 200 | 250 | 300 | 350 | 400 | 450 |
|---|---|---|---|---|---|---|---|---|
| 550 | 85 | 92 | 98 | 105 | 111 | 117 | 124 | 130 |
| | 80 | 87 | 93 | 99 | 106 | 112 | 119 | 125 |
| 600 | 92 | 98 | 105 | 111 | 117 | 124 | 130 | 136 |
| | 87 | 93 | 99 | 106 | 112 | 119 | 125 | 131 |
| 650 | 98 | 105 | 111 | 117 | 124 | 130 | 136 | 143 |
| | 93 | 99 | 106 | 112 | 119 | 125 | 131 | 138 |
| 700 | 105 | 111 | 117 | 124 | 130 | 136 | 143 | 149 |
| | 99 | 106 | 112 | 119 | 125 | 131 | 138 | 144 |
| 750 | 111 | 117 | 124 | 130 | 136 | 143 | 149 | 156 |
| | 106 | 112 | 119 | 125 | 131 | 138 | 144 | 150 |
| 800 | 117 | 124 | 130 | 136 | 143 | 149 | 156 | 162 |
| | 112 | 119 | 125 | 131 | 138 | 144 | 150 | 157 |
| 850 | 124 | 130 | 136 | 143 | 149 | 156 | 162 | 168 |
| | 119 | 125 | 131 | 138 | 144 | 150 | 157 | 163 |
| 900 | 130 | 136 | 143 | 149 | 156 | 162 | 168 | 175 |
| | 125 | 131 | 138 | 144 | 150 | 157 | 163 | 170 |
FIG. 5

METHOD AND ARRANGEMENT FOR CONTROLLING THE FUEL/AIR RATIO OF AN INTERNAL COMBUSTION ENGINE

FIELD AND BACKGROUND OF THE INVENTION

The present invention relates to a method and arrangement for controlling the fuel/air ratio of an internal combustion engine in which the output voltage of an oxygen measurement probe which is arranged in the exhaust pipe of the internal combustion engine is used, after comparison with threshold values, to control the fuel/air ratio.

The oxygen measurement probes known at the present time produce an output voltage of about 0.75 V in case of a deficiency of oxygen and an output voltage of about 0.1 V in the case of an excess of oxygen. For the evaluation of the output voltage it is known to establish threshold values whereby the output voltage of the oxygen measurement probe is converted into a rectangular voltage. In the case of an aged oxygen measurement probe, the output voltage decreases, so that, for instance, only 0.55 V is present instead of 0.75 V in the case of a deficiency of oxygen. This has the result that, because of the gradual transfers in the case of an aged oxygen measurement probe a threshold value established for a voltage of 0.75 V is reached later than in the case of a new oxygen measurement probe. An impairing of the control thus results.

SUMMARY OF THE INVENTION

It is an object of the present invention to avoid the disadvantages of the known control methods.

According to the invention, the threshold values can be controlled as a function of extreme values of the output voltage.

The method of the invention is suitable for different fuel injection systems such as, for instance, continuous or intermittent injection systems with central or cylinder injection.

A further development of the invention is that the threshold values are stored in a nonvolatile memory and that the data which has been obtained by a determination of the extreme values of the output voltage are fed to the nonvolatile memory as addresses for the reading of the stored threshold values. This further development can be carried out in simple manner with the means of modern microelectronics.

In accordance with another further development, before the determination of the extreme values, the output voltage is subjected to low-pass filtration and boosted. In this way, on the one hand, falsification of the determination of the extreme values by the noise superimposed on the output voltage is prevented while, on the other hand, the input voltage range of an analog-to-digital converter present in the control apparatus is extensively utilized.

The use of the method of the invention in connection with the determination of the readiness for operation of the oxygen measurement probe is made possible by a further aspect of the invention wherein an integrator is provided. The integration time constant of the integrator is dependent on the internal resistance of the oxygen measurement probe. A rate of change of the output voltage is measured by measuring the time which the output voltage of the integrator requires in order to pass from a first further threshold value to a second further threshold value. The first and the second further threshold values can be controlled as a function of the extreme values of the oxygen measurement probe.

Another feature makes it possible, upon the next initiation of operation of the internal combustion engine, to again use the threshold values which were determined, whereby the relationship between the further threshold values and the extreme values of the oxygen measurement probe is stored in a nonvolatile memory.

Finally, in another further aspect of the invention, after the start of the internal combustion engine, the rate of change of the output voltage of the integrator is first of all compared with threshold values stored in the nonvolatile memory until the threshold values are reached; that thereupon the output voltage of the oxygen measurement probe is measured, and the further threshold values are adjusted in accordance with the result of said measurement. Thereupon the rate of change of the integrator output voltage is measured taking as basis the adjusted further threshold values. In the event of a sufficiently large rate of change, the regulation of the fuel/air ratio is allowed to act. In this way, a particularly reliable recognition of readiness for operation is assured.

One embodiment of the method of the invention is attained by use of a microcomputer (31) which has at least one input (56), at a multiplexer (33), for an analog signal and by the fact that the output of the oxygen measurement probe (11) is connected via an amplifier stage (68–70) and at least one low-pass filter (66, 67; 71, 72) to the input (56) of the microcomputer (31).

Due to the high internal resistance of the oxygen measurement probe, the invention employs a negative feedback MOS operational amplifier (69). The output voltage of the oxygen measurement probe (11) is fed to the input of the amplifier (69) over a first low-pass filter (66, 67), and that the output voltage of the amplifier (69) is fed to the input (56) of the microcomputer (31) over a second low-pass filter (71, 72).

For protection against overvoltage, a voltage limiter (73, 74) can be provided at the input (56) of the microcomputer (31).

A further feature for recognition of readiness of operation of the oxygen measurement probe is attained by connecting the output of the oxygen measurement probe (11) to another input (55), at the multiplexer (33), of the microcomputer (31). This input is provided for analog signals via an integrator circuit (45,46, 49), the circuitry which determines the integration time constant comprising the internal resistance (43) of the oxygen measurement probe (11).

In this case, the integrator circuit (45, 46, 49) can preferably be set by the microcomputer (31) at an initial value which preferably lies at the half of the output voltage range provided.

BRIEF DESCRIPTION OF THE DRAWINGS

With the above and other objects and advantages in view, the present invention will become more clearly understood in connection with a detailed description of preferred embodiments when considered with the accompanying drawings, of which:

FIGS. 4*a* and 4*b* show graphs for the recognition of the readiness for operation of the oxygen measurement probe; and FIG. 5 is a table containing threshold values as a function of the extreme values of the output voltage of the oxygen measurement probe.

DETAILED DESCRIPTION OF THE PREFERRED EMBODIMENT

Figure 1:
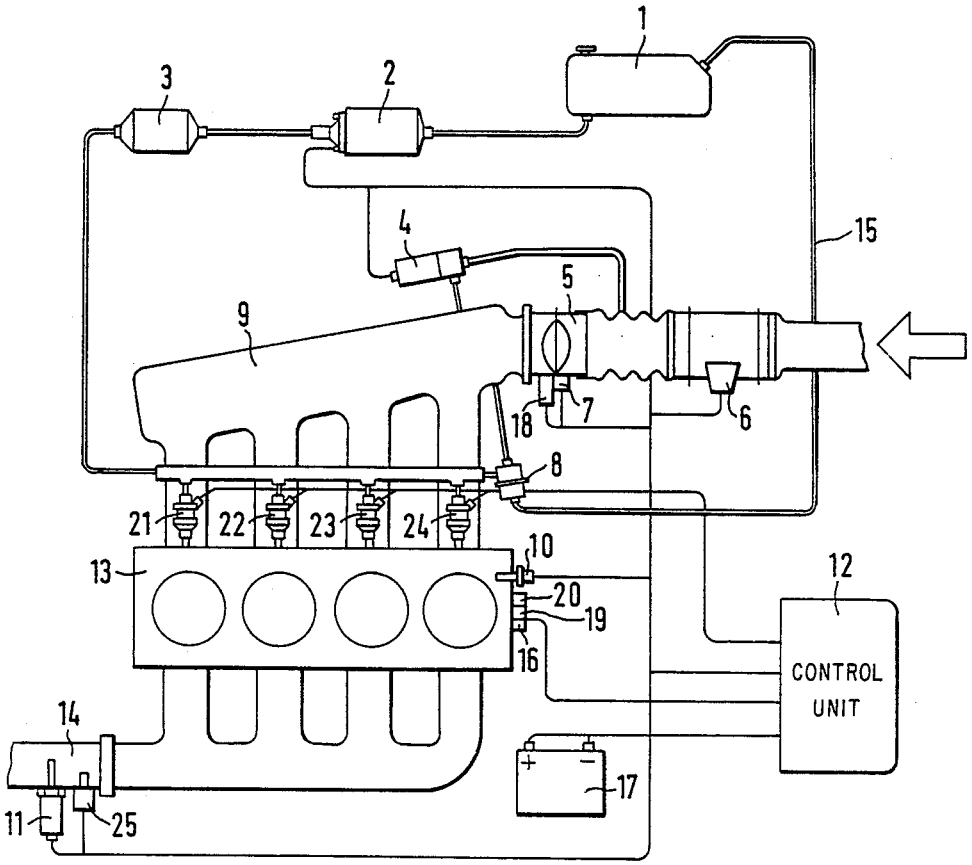
FIG. 1 shows a fuel injection system of a four-cylinder engine which is suitable for carrying out the method of the invention.

In the fuel injection system shown diagrammatically in FIG. 1, an injection valve 21, 22, 23, 24 is provided for each cylinder of the engine 13. The injection valves are part of a fuel circuit which consists, in known manner, of a tank 1, an electric fuel pump 2, a fuel filter 3 and a pressure regulator 8, the excess fuel being returned to the tank 1 via a line 15.

The combustion air is received by the engine 13 from an air filter (not shown) via an air-mass meter 6, a throttle valve 5 and an intake manifold 9. The controlling element, an idle setter, 4 of an idle controller is contained in a bypass to the throttle valve 5.

In the exhaust pipe 14 of the engine 13 there is located an oxygen measurement probe 11, the electrical output signal of which is dependent, in known manner, on the proportion of oxygen in the exhaust gases. The temperature of the engine 13 is measured by a temperature sensor 10. Furthermore, a speed-of-rotation transmitter 16, a crankshaft position indicator 19 and an ignition signal transmitter 20 are provided on the engine 13. A temperature sensor 25 measures the exhaust gas temperature.

The position of the throttle valve is transmitted by a transmitter 7, in addition to the signals of the aforementioned sensors, to the control unit 12, a switch signal which characterizes the idle position being furthermore produced by switch 18. Control devices for the electronic control of the fuel injection are known per se, so that only a diagrammatic explanation of one such control instrument will be given in connection with the present invention based on FIG. 2.

Figure 2:
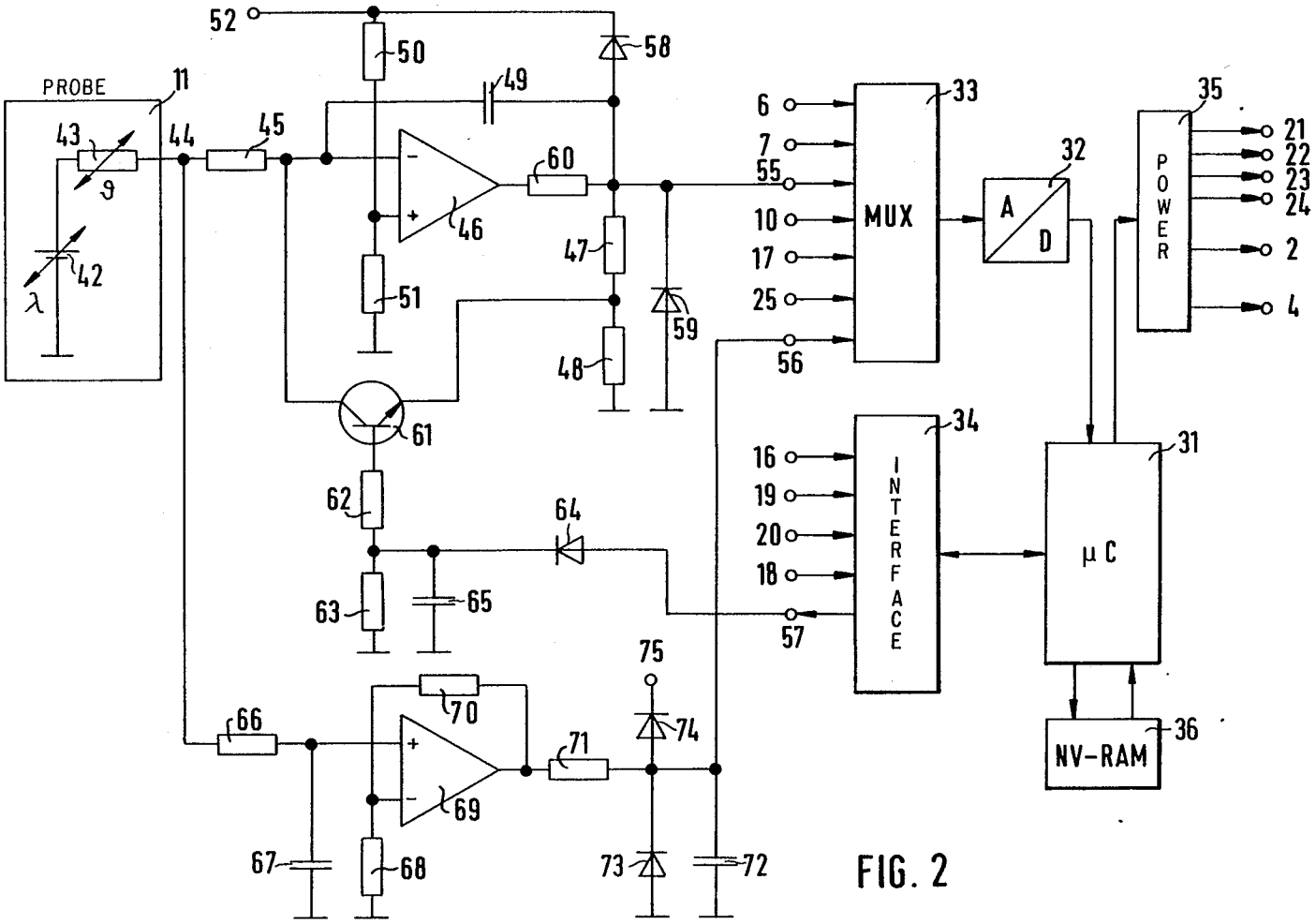
FIG. 2 is a block diagram of an arrangement in accordance with the invention.

As shown in FIG. 2, the control device 12 has a microcomputer 31 which controls the required functions in accordance with an established program. The analog variables are fed via a multiplexer 33 and an analog-to-digital converter 32, while pulse-like variables or binary signals pass via interfaces unit 34 to the microcomputer 31. Via an interface of the unit 34, a switch signal is also given to the output 57. On the output side, the microcomputer 31 is connected to power stage unit 35 wherein, for each injection valve, there is a power stage as well as a power stage for controlling a relay (not shown) for the fuel pump 2 (FIG. 1) and a power stage for the idle setter 4. For the storing of the data, even when the control device is disconnected, a nonvolatile memory 36, for instance an NV-RAM, is connected to the microcomputer. The microcomputer 31 itself consists in known manner of various units (not shown) such as a microprocessor, a bus system, a read-only memory for the program and constants, and a write-read memory for variables.

Analog signals are fed to the inputs of the multiplexer 33 from the air-mass meter 6, the throttle-valve position transmitter (throttle-valve potentiometer) 7, the cooling-water temperature sensor 10 and the exhaust-gas temperature sensor 21, and the vehicle electrical voltage is fed from the battery 17. The inputs of the interfaces of unit 34 are connected to the speed-of-rotation transmitter 16, the crankshaft-position transmitter 19, the ignition-signal transmitter 20, and the throttle-valve switch 18.

The oxygen measurement probe 11 is shown in FIG. 2 as a source of voltage 42, the voltage of which is dependent on the proportion of oxygen and the internal resistance 43 which is temperature dependent. The output voltage of the oxygen measurement probe 11 is fed from the probe output 44 to inputs of two circuits, the outputs of which are connected to inputs 55, 56 of the multiplexer 33. In this case, the first circuit is formed essentially by the operational amplifier 46 and the second circuit by the operational amplifier 69.

The operational amplifier 46 together with the external wiring represents a known integrator, the integration constant being dependent on the internal resistance of the oxygen measurement probe, on the resistor 45 and on the capacitor 49. A part of the operating voltage fed at 52 is fed to the non-inverting input of the operational amplifier 46 via a voltage divider of resistors 50, 51.

The resistor 51 of the voltage divider 50, 51 may be variable so that the voltage present at the noninverting input can be set. The output of the operational amplifier 46 is connected via a resistor 60 to the input 55 of the multiplexer 33. Double Schottky diodes 58, 59 protect the input 55 from overvoltages.

A control voltage is fed from the output 57 of the interface unit 34 to the base of a transistor 61 which connects the output of the voltage divider of resistors 47, 48 to the inverting input of the operational amplifier 46. In this case, a circuit consisting of the resistors 62, 63, the diode 64 and the capacitor 65 serves to produce a bias voltage for the transistor 61. In known manner, the microcomputer 31 is designed by means of a stored program so as to regulate the amount of fuel fed to the internal combustion engine in order to assure complete combustion. For this purpose, as in the example shown, the period of injection or, in the case of other injection systems, the system pressure, is controlled accordingly. Such systems are known and need not be explained in further detail in connection with the present invention.

The rate of change of the output voltage of the integrator is dependent on the internal resistance 43 of the oxygen measurement probe 11. Therefore, by measuring the rate of change by means of the microcomputer 31, it can be determined whether the internal resistance 43 of the oxygen measurement probe 11 has a value which is sufficiently low for the unambiguous determination of the output voltage. The determination of the output voltage of the oxygen measurement probe 11 in itself is effected via the input 56 to which the amplified output voltage of the oxygen measurement probe is fed via the operational amplifier 69. The amplification amounts in this case to a factor of about five, so that the voltage swing of the oxygen measurement probe on the input voltage range of the analog-to-digital converter 32 is amplified. In order that the evaluation of the output signal of the oxygen measurement probe not be falsified by noise, two low-pass filters 66, 67, and 71, 72 are provided. For the limiting of the output voltage of the operational amplifier there are used two double Schottky diodes 73, 74, the diode 74 being fed a potential of 5 V via the connection 75.

Figure 3:
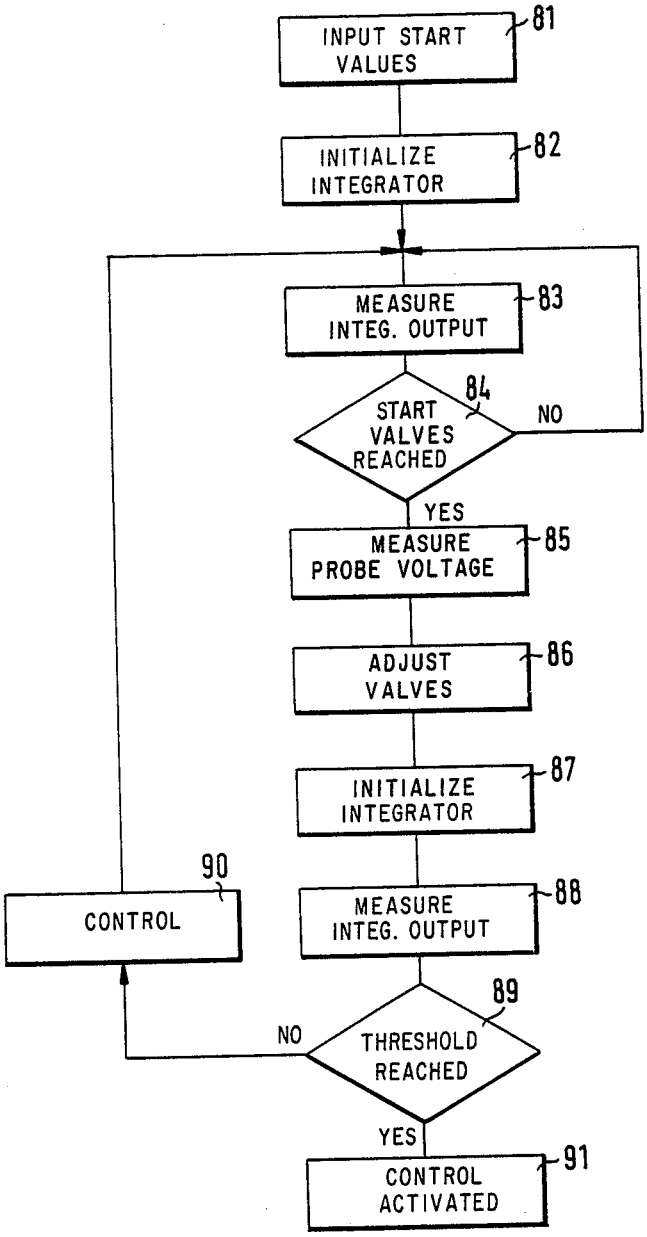
FIG. 3 is a flowchart of a part of the program intended for the microcomputer.

The recognition of the readiness for operation of the oxygen measurement probe in the case of the arrangement shown in FIG. 2 will now be explained on basis of FIG. 3. The program according to FIG. 3 represents merely a portion of the total program serving for controlling the fuel/air ratio to the engine 13. In the program portion 81 after the start, two preestablished values (starting values) are read as threshold values for the output voltage of the integrator from a read-only memory. Thereupon, at 82, the integrator is set to the initial value, for which purpose a corresponding pulse is given off via the output 57 by the microcomputer 31 (FIG. 2). At 83, the integrator output voltage from the input 55 is read into the microcomputer and at 84 the program branches off as a function of whether the starting values have or have not already been reached. As long as they have not, program parts 83 and 84 are repeated. After the starting values are reached, the output voltage of the oxygen measurement probe is read at 85. Depending on the measured output voltage of the oxygen measurement probe, new threshold values are read out in the program part 86 from a table which contains functions according to FIG. 4, and replace the starting values.

The integrator is then again set at 87 to its new starting value, and at 88 the output voltage of the integrator is measured. This is followed at 89 by a branching of the program, depending on whether the threshold values read from the table have or have not been reached. If not, the fuel/air ratio is adjusted at 90 without the use of the output voltage of the oxygen measurement probe. The program is then repeated at 83. However, if the new threshold value has been reached, then the regulation of the fuel/air ratio according to the output signal of the oxygen measurement probe is activated at 91. The program shown in FIG. 3 is not merely passed through once after the placing in operation of the internal combustion engine, but is passed through at repeated intervals during operation. If the probe is ready for operation, then the regulation which was already previously activated is retained at 91.

The diagrams of FIG. 4 show the relationship, set forth as a table in FIG. 5, between the measured output voltage Us of the oxygen measurement probe and the threshold values for the output voltage Ui of the integrator which are used for the recognition of readiness for operation. FIG. 4*a* shows the dependence of the lower threshold value on the value of the output voltage Us of the oxygen measurement probe for a rich mixture, and FIG. 4*b* shows the dependence of the upper threshold value on the value of the output voltage for a lean mixture. This association is due, inter alia, to the fact that the integrator formed by means of the operational amplifier 46 effects an inversion.

For the regulating of the fuel/air ratio with the oxygen measurement probe ready for operation, its output signal is fed via the operational amplifier 69, amplified by approximately a factor of 5, to the input 56 of the multiplexer 33 and thus to the analog-to-digital converter 32. By comparison with two threshold values, a binary signal is produced in the microcomputer 31. By the use of two threshold values one avoids the occurrence of a continuous jump of the binary signal in the case of an output voltage of the oxygen measurement probe which oscillates around only one threshold value.

In the method of the invention, the threshold values are controlled as a function of the extreme values of the output voltage. For this purpose, the extreme values - therefore the voltage with rich mixture and the voltage with lean mixture are determined and corresponding threshold values are taken from a table stored in a memory. One such table is shown in FIG. 5. In the columns of the table, different threshold values are set forth in each case for a voltage value for too rich a mixture (Umin). The lines contain threshold values for in each case a threshold value for too lean a mixture (Umax). If, for instance, in a new probe Umax=900 mV and Umin=100 mV, then the threshold values amount to 130 and 125. In this case, the upper value comes into use upon a shift in the probe from lean to rich, while the bottom value applies for a lower shift from rich to lean. The figures represent quantification steps in the case of an 8-bit analog-to-digital conversion in which 255 quantification steps are possible.

If, Umax and Umin decrease or increase equally upon an assumed aging of the oxygen measurement probe, then the values 130 and 125 do not change. However, if one of these values changes then other threshold values are used for the control. Thus, for instance, with Umin=200 mV and Umax=550 mV, the upper threshold value is 98 and the lower threshold value is 93.

I claim:

1. A method for controlling the fuel/air ratio of an internal combustion engine with an oxygen measurement probe located in the exhaust pipe of the internal combustion engine, wherein an output voltage of the probe is employed for controlling the fuel/air ratio, the method including steps of comparing the output voltage of the probe to threshold values of probe voltage;

controlling the threshold values as a function of extreme values of the probe output voltage;

determining data of extreme values of the probe output voltage;

storing the threshold values in a nonvolatile memory; and feeding data which has been obtained by a determination of the extreme values of the output voltage to the nonvolatile memory as addresses for a reading of stored threshold values.

2. The method according to claim 1, wherein prior to said step of determining extreme value data, there is a step of subjecting the probe output voltage to low-pass filtration and boosting.

3. The method according to claim 1, wherein for the determination of readiness for operation of the oxygen measurement probe, there are steps of integrating the probe output voltage by use of an integrator having an integration time constant dependent on internal resistance of the oxygen measurement probe;

measuring a rate of change of the probe output voltage by measuring a time interval during which the output voltage of the integrator passes from a first threshold value to a second threshold value; and controlling the first and the second threshold values as a function of the extreme values of the probe output voltage.

4. The method according to claim 3, further comprising storing a relationship between the threshold values and the extreme values of the probe output voltage in the nonvolatile memory.

5. The method according to claim 4, further comprising after a start of the internal combustion engine, comparing a rate of change of the output voltage of the integrator with threshold values stored in the nonvolatile memory until the threshold values are reached;

measuring the probe output voltage;

adjusting the threshold values in accordance with the result of said probe-voltage measuring step;

measuring a rate of change of the integrator output voltage taking as basis the adjusted threshold values; and in the event of a rate of change larger than a predetermined rate, acting upon the regulation of the fuel-/air ratio.

6. The method according to claim 3, further comprising after a start of the internal combustion engine, comparing a rate of change of the output voltage of the integrator with threshold values stored in the non-volatile memory until the threshold values are reached;

measuring the probe output voltage;

adjusting the threshold values in accordance with the result of said probe-voltage measuring step;

measuring a rate of change of the integrator output voltage taking as basis the adjusted threshold values; and in the event of a rate of change larger than a predetermined rate, acting upon the regulation of the fuel-/air ratio.

7. A system for controlling the fuel/air ratio of an internal combustion engine with an oxygen measurement probe located in the exhaust pipe of the engine, wherein an output voltage of the probe is processed by comparison with threshold values for controlling the fuel/air ratio, the system comprising:

a microcomputer which has at least one input for receiving an analog signal;

an amplifier and a low-pass filter; and wherein the output voltage of the oxygen measurement probe is connected via the amplifier and the low-pass filter to the input of the microcomputer;

a second low-pass filter; and wherein the amplifier is a negative feedback MOS operational amplifier;

the probe output voltage is feedable to an input of the amplifier over the first-mentioned low-pass filter; and an output voltage of the amplifier is feedable to the input of the microcomputer via the second low-pass filter.

8. The system according to claim 7, further comprising a voltage limiter provided at the input of the microcomputer.

9. The system according to claim 7, further comprising an integrator circuit including an element which determines integration time, said element of the integration circuit being the internal resistance of the probe; and wherein the microcomputer has a second input terminal for receipt of analog signals, and the probe output voltage is connected to said second input terminal of the microcomputer via the integrator circuit.

10. The system according to claim 9, wherein the integrator circuit is set by the microcomputer at an initial value of integration time.

11. The system according to claim 10, wherein said initial value lies at half of a predetermined output voltage range.

* * * * *